US007029543B2

(12) United States Patent
Bull et al.

(10) Patent No.: US 7,029,543 B2
(45) **Date of Patent: *Apr. 18, 2006**

(54) PROCESS FOR MAKING ALUMINUM ALLOY SHEET HAVING EXCELLENT BENDABILITY

(75) Inventors: Michael Jackson Bull, Brighton, MI (US); David James Lloyd, Bath (CA)

(73) Assignee: Novelis, Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/863,557

(22) Filed: Jun. 8, 2004

(65) Prior Publication Data

US 2004/0250928 A1 Dec. 16, 2004

Related U.S. Application Data

(63) Continuation of application No. 10/138,844, filed on May 2, 2002, now Pat. No. 6,780,259.

(60) Provisional application No. 60/288,382, filed on May 3, 2001.

(51) Int. Cl.
*C22F 1/05* (2006.01)

(52) U.S. Cl. ..... 148/552; 148/693; 148/694

(58) Field of Classification Search ..... 148/552, 148/693, 694, 697, 698, 700
See application file for complete search history.

(56) References Cited

U.S. PATENT DOCUMENTS

| | | | |
|---|---|---|---|
| 4,082,578 | A | 4/1978 | Evancho et al. |
| 4,718,948 | A | 1/1988 | Komatsubara et al. |
| 4,808,247 | A | 2/1989 | Komatsubara et al. |
| 4,814,022 | A | 3/1989 | Constant et al. |
| 4,897,124 | A | 1/1990 | Matsuo et al. |
| 5,266,130 | A | 11/1993 | Uchida et al. |
| 5,616,189 | A | 4/1997 | Jin et al. |
| 6,120,623 | A | 9/2000 | Gupta et al. |
| 2003/0015261 | A1 | 1/2003 | Bull et al. |

FOREIGN PATENT DOCUMENTS

| | | |
|---|---|---|
| DE | 1941657 | 2/1971 |
| GB | 1267235 | 3/1972 |
| JP | 2-205660 A | 8/1990 |
| JP | 2000-038634 | 2/2000 |
| WO | WO 9607768 | 3/1996 |
| WO | WO 9837251 | 8/1998 |
| WO | WO 0052219 | 9/2000 |

*Primary Examiner*—George Wyszomierski
*Assistant Examiner*—Janelle Morillo
(74) *Attorney, Agent, or Firm*—Cooper & Dunham LLP

(57) ABSTRACT

A process is described for producing an aluminum alloy sheet having excellent bendability for use in forming panels for automobiles. An aluminum alloy containing 0.50 to 0.75 by weight Mg, 0.7 to 0.85% by weight Si, 0.1 to 0.3% by weight Fe, 0.15 to 0.35% by weight Mn, and the balance Al and incidental impurities, is used and is semi-continuously cast into ingot. The cast alloy ingot is subjected to hot rolling and cold rolling, followed by solution heat treatment of the formed sheet. The heat treated sheet is quenched to a temperature of about 60–120° C. and the sheet is then coiled. This coil is then pre-aged by slowly cooling the coil from an initial temperature of about 60–120° C. to room temperature at a cooling rate of less than 10° C./hr.

10 Claims, 12 Drawing Sheets

PROCESS FOR MAKING ALUMINUM ALLOY SHEET HAVING EXCELLENT BENDABILITY

CROSS REFERENCE TO RELATED APPLICATIONS

This application Ser. No. 10/138,844, filed May 2, 2002 now U.S. Pat. No. 6,780,259 (allowed) which claims the benefit of U.S. provisional application No. 60/288,382, filed May 3, 2001.

BACKGROUND OF THE INVENTION

1. Field of the Invention

This invention relates to the production of aluminum alloy sheet for the automotive industry, particularly for body panel applications, having excellent bendability, together with good paint bake response and recyclability.

2. Description of the Prior Art

Various types of aluminum alloys have been developed and used in the production of automobiles, particularly as automobile body panels. The use of aluminum alloys for this purpose has the advantage of substantially reducing the weight of the automobiles. However, introduction of aluminum alloy panels creates its own set of needs. To be useful in automobile applications, an aluminum alloy sheet product must possess good forming characteristics in the as-received condition, so that it may be bent or shaped as desired without cracking, tearing or wrinkling. In particular, the panels must be able to withstand severe bending, as occurs during hemming operations, without cracking. Hemming is the common way of attaching outer closure sheets to underlying support panels and results in the edges of the sheet being bent nearly back on itself In addition to this excellent bendability, the aluminum alloy panels, after painting and baking, must have sufficient strength to resist dents and withstand other impacts.

Aluminum alloys of the AA (Aluminum Association) 6000 series are widely used for automotive panel applications. It is well known that a lower T4 yield strength (YS), and reduced amount of Fe, will promote improved formability, particularly hemming performance. A lower yield strength can be achieved by reducing the solute content (Mg, Si, Cu) of the alloy, but this has traditionally resulted in a poor paint bake response, less than 200 MPa T8 (0% strain). This poor paint bake response can be countered by increasing the gauge, or by artificially aging the formed panels. However, both of these approaches increase the cost and are unattractive options. Furthermore, a reduced Fe content is not sustainable with the use of significant amounts of scrap in the form of recycled metal. This is because the scrap stream from stamping plants tends to be contaminated with some steel scrap that causes a rise in the Fe level.

Furthermore, the necessary material characteristics of outer and inner panels are sufficiently different that the natural trend is to specialize the alloys and process routes. For example, an AA5000 alloy may be used for inner panels and an AA6000 alloy for outer panels. However, to promote efficient recycling it is highly desirable to have the alloys used to construct both the inner and outer panel of a hood, deck lid, etc. to have a common or highly compatible chemistry. At the very least, the scrap stream must be capable of making one of the alloys, in this case the alloy for the inner panel.

In Uchida et al. U.S. Pat. No. 5,266,130 a process is described for manufacturing aluminum alloy panels for the automotive industry. Their alloy include as essential components quite broad ranges of Si and Mg and may also include Mn, Fe, Cu, Ti, etc. The examples of the patent show a pre-aging treatment that incorporates a cooling rate of 4° C./min from 150° C. to 50° C.

In Jin et al. U.S. Pat. No. 5,616,189 a further process is described for producing aluminum sheet for the automotive industry. Again, alloys used contain Cu, Mg, Mn and Fe. The aluminum sheet produced from these alloys was subjected to a 5 hour pre-age treatment at 85° C. The disclosure furthermore states that the sheet can be coiled at 85° C. and allowed to cool slowly to ambient at a rate of less than 10° C./hr. The aluminum sheet used in this patent was a continuous cast (CC) sheet and sheet products produced by this route have been found to exhibit poor bendability.

It is an object of the present invention to provide an improved processing technique whereby an aluminum alloy sheet is formed which has excellent bendability.

It is a further object of the invention to provide an aluminum alloy sheet product having good paint bake response.

It is a still further object of the invention to provide an aluminum alloy sheet product which is capable of being recycled for use in the production of automotive body panels.

SUMMARY OF THE INVENTION

In accordance with one embodiment of this invention, an aluminum alloy sheet of improved bendability is obtained by utilizing an alloy of the AA6000 series, with carefully selected Mg and Si contents and, with an increased manganese content and a specific pre-age treatment. The alloy used in accordance with this invention is one containing in percentages by weight 0.50–0.75% Mg, 0.7–0.85% Si, 0.1–0.3% Fe and 0.15–0.35% Mn. According to an alternative embodiment, the alloy may also contain 0.2–0.4% Cu.

The procedure used for the production of the sheet product is the T4 process with pre-aging, i.e. T4P. The pre-aging treatment is the last step in the procedure.

The target physical properties for the sheet products of this invention are as follows:

| | |
|---|---|
| T4P, YS | 90–120 MPa |
| T4P UTS | >200 MPa |
| T4P El | >28% ASTM, >30% (Using JIS Specimen) |
| BEND, $r_{min}/t$ | <0.5 |
| T8 (0% strain), YS | >210 MPa |
| T8 (2% strain), YS | >250 MPa |

In the above, T4P indicates a process where the alloy has been solution heat treated, pre-aged and naturally aged for at least 48 hours. UTS indicates tensile strength, YS indicates yield strength and El indicates total elongation. BEND represents the bend radius to sheet thickness ratio and is determined according to the ASTM 290C standard wrap bend test method. T8 (0% or 2% strain) represents the YS after a simulated paint bake of either 0% or 2% strain and 30 min at 177° C.

For Cu-free alloys the functional relationships are revealed which allow the T4P strengths to be related to alloy composition, and the paint bake strength to the T4P strength.

The T4P yield strength is given by:

$$T4P\ YS(\text{MPa})=130(\text{Mg wt }\%)+80(\text{Si wt }\%)-32$$

where the T4P is obtained by a simulated pre-age of 85° C. for 8 hours.

The T8 (0% strain) yield strength is given by:

$$T8(\text{Mpa})=0.9(T4P)+134$$

Using these relationships the following alloys will meet the T4P/T8(0%) requirements:

*T4P*90 MPa, *T*8 215 MPa+(0.5 wt % Mg–0.7 wt % Si)

*T4P*110 MPa, *T*8 233 MPa+(0.6 wt % Mg–0.8 wt % Si)

*T4P*120 MPa, *T*8 242 MPa+(0.75 wt % Mg–0.7 wt % Si)

and this gives the nominal composition range for the alloys of the invention of Al-0.5 to 0.75 wt % Mg-0.7 to 0.8 wt % Si.

For Cu containing alloys, the functional relationships are not so straightforward and depend on the Mg and Si content. A Cu content of about 0.2–0.4 wt % is desirable for enhanced paint bake performance.

For reasons of grain size control, it is preferable to have at least 0.2 wt % Mn. Mn also provides some strengthening to the alloy. Fe should be kept to the lowest practical limit, not less than 0.1 wt %, or more than 0.3 wt % to avoid forming difficulties.

For the outer panel the Fe level in the alloy will tend toward the minimum for improved hemming. On the other hand, the Fe level in the alloy for inner panel applications will tend towards the maximum level as the amount of recycled material increases.

The alloy used in accordance with this invention is cast by semi-continuous casting, e.g. direct chill (DC) casting. The ingots are homogenized and hot rolled to reroll gauge, then cold rolled and solution heat treated. The heat treated strip is then cooled by quenching to a temperature of about 60–120° C. and coiled. This quench is preferably to a temperature of about 70–100° C., with a range of 80–90° C. being particularly preferred. The coil is then allowed to slowly cool to room temperature at a rate of less than about 10° C./hr, preferably less than 5° C./hr. It is particularly preferred to have a very slow cooling rate of less than 3° C./hr.

The homogenizing is typically at a temperature of more than 550° C. for more than 5 hours and the reroll exit gauge is typically about 2.54–6.3 mm at an exit temperature of about 300–380° C. The cold roll is normally to about 1.0 mm gauge and the solution heat treatment is typically at a temperature of about 530–570° C.

Alternatively, the sheet may be interannealed in which case the reroll sheet is cold rolled to an intermediate gauge of about 2.0–3.0 mm. The intermediate sheet is batch annealed at a temperature of about 345–410° C., then further cold rolled to about 1.0 mm and solution heat treated.

The pre-aging according to this invention is typically the final step of the T4 process, following the solution heat treatment. However, it is also possible to conduct the pre-aging after the aluminum alloy strip has been reheated to a desired temperature.

It has also been found that it is particularly beneficial to conduct the quench from the solutionizing temperature in two stages. The alloy strip is first air quenched to about 400–450° C., followed by a water quench.

The sheet product of the invention has a YS of less than 125 MPa in the T4P temper and greater than 250 MPa in the T8(2%) temper. With an interanneal, the sheet product obtained has a YS of less than 120 MPa in the T4P temper and greater than 245 MPa in the T8(2%) temper.

A higher quality sheet product is obtained according to this invention if the initial aluminum alloy ingots are large commercial scale castings rather than the much small laboratory castings. For best result, the initial castings have a cast thickness of at least 450 mm and a width of at least 1250 mm.

With the procedure of this invention, a sheet is obtained having very low bendability (r/t) values, e.g. in the order of 0.2–0, with an excellent paint bake response. Such low values are very unusual for AA6000 alloys and, for instance, a conventionally processed AA6111 alloy sheet will have a typical r/t in the order of 0.4–0.45.

DESCRIPTION OF THE PREFERRED EMBODIMENTS

A particularly preferred procedure for producing an aluminum alloy for inner panels applications according to the invention includes DC casting and scalping ingots, then homogenization preheat at 520° C. for 6 hours (furnace temp.) followed by 560° C. for 4 hours (metal temp.). This is hot rolled to a reroll exit gauge of 2.54 mm with an exit temperature of 300–330° C., followed by cold rolling to 0.85 to 1.0 mm. The sheet is then solution heat treated with a PMT of 530–570° C. and an air quench to 450–410° C.(quench rate 20–75 C/s), followed by a water quench from 450–410 to 280–250 C. (quench rate 75–400 C/s). Next it is air quenched to 80–90° C. and coiled (actual coiling temp.). Thereafter the coil is cooled to 25° C. This procedure is described as the T4P practice.

A particularly preferred procedure for producing an aluminum alloy for outer panel applications includes DC casting ingots and surface scalping, followed by homogenization preheat at 520° C. for 6 hours (furnace temp.), then 560° C. for 4 hours (metal temp.). The ingot is then hot rolled to a reroll exit gauge of 3.5 mm with an exit temperature of 300–330° C., followed by cold rolling to 2.1 to 2.2 mm. The sheet is batch annealed for 2 hours at 380° C.+/−15° C. followed a further cold roll to 0.85 to 1.0 mm. This is followed by a solution heat treat with a PMT of 530–570° C., then an air quench to 450–410° C. (quench rate 20–75 C/s) and a water quench from 450–410 to 280–250° C. (quench rate 75–400° C./s). Finally, the sheet is air quenched to 80–90° C. and coiled (actual coiling temp.). The coil is then cooled to 25° C. This procedure is the T4P practice with interanneal.

BRIEF DESCRIPTION OF THE DRAWINGS

In the drawings which illustrate the invention.

EXAMPLE 1

Two alloys were tested with and without manganese present. Alloy AL1 contained 0.49% Mg, 0.7% Si, 0.2% Fe, 0.011% Ti and the balance aluminum and incidental impurities, while alloy AL2 contained 0.63% Mg, 0.85% Si, 0.098% Mn, 0.01% Fe, 0.013% Ti and the balance aluminum and incidental impurities.

The alloys were laboratory cast as 3¾×9" DC ingots. These ingots were scalped and homogenized for 6 hours at 560° C. and hot rolled to 5 mm, followed by cold rolling to 1.0 mm. The sheet was solutionized at 560° C. in a salt bath and quenched to simulate the T4P practice.

The results obtained are shown in Table 1 below:

TABLE 1

| ALLOY | T4P YIELD (MPa) | PAINT BAKE YIELD (MPa) | BENDABILITY $r_{MIN}/t$ |
|---|---|---|---|
| AL1 | 87.5 | 219 | 0.2 |
| AL2 | 111 | 213 | 0 |

Both alloys gave 29–30% tensile elongation with JIS (Japanese Standard) specimen configuration. The paint bake is T8 (0% strain).

EXAMPLE 2

Two alloys in accordance with the invention (AL3 and AL4) and two comparative alloys (C1 and C2) were prepared with the compositions in Table 2 below:

TABLE 2

| | Chemical Composition(wt %, ICP) | | | | | | |
|---|---|---|---|---|---|---|---|
| | Alloy | Mg | Si | Mn | Cr | Fe | Ti |
| Invention | AL3 | 0.62 | 0.80 | 0.19 | — | 0.22 | 0.01 |
| | AL4 | 0.60 | 0.80 | 0.11 | 0.11 | 0.21 | 0.01 |
| Comparison | C1 | 0.60 | 0.81 | 0.00 | — | 0.20 | 0.01 |
| | C2 | 0.62 | 0.84 | 0.10 | — | 0.22 | 0.01 |

Figure 1:
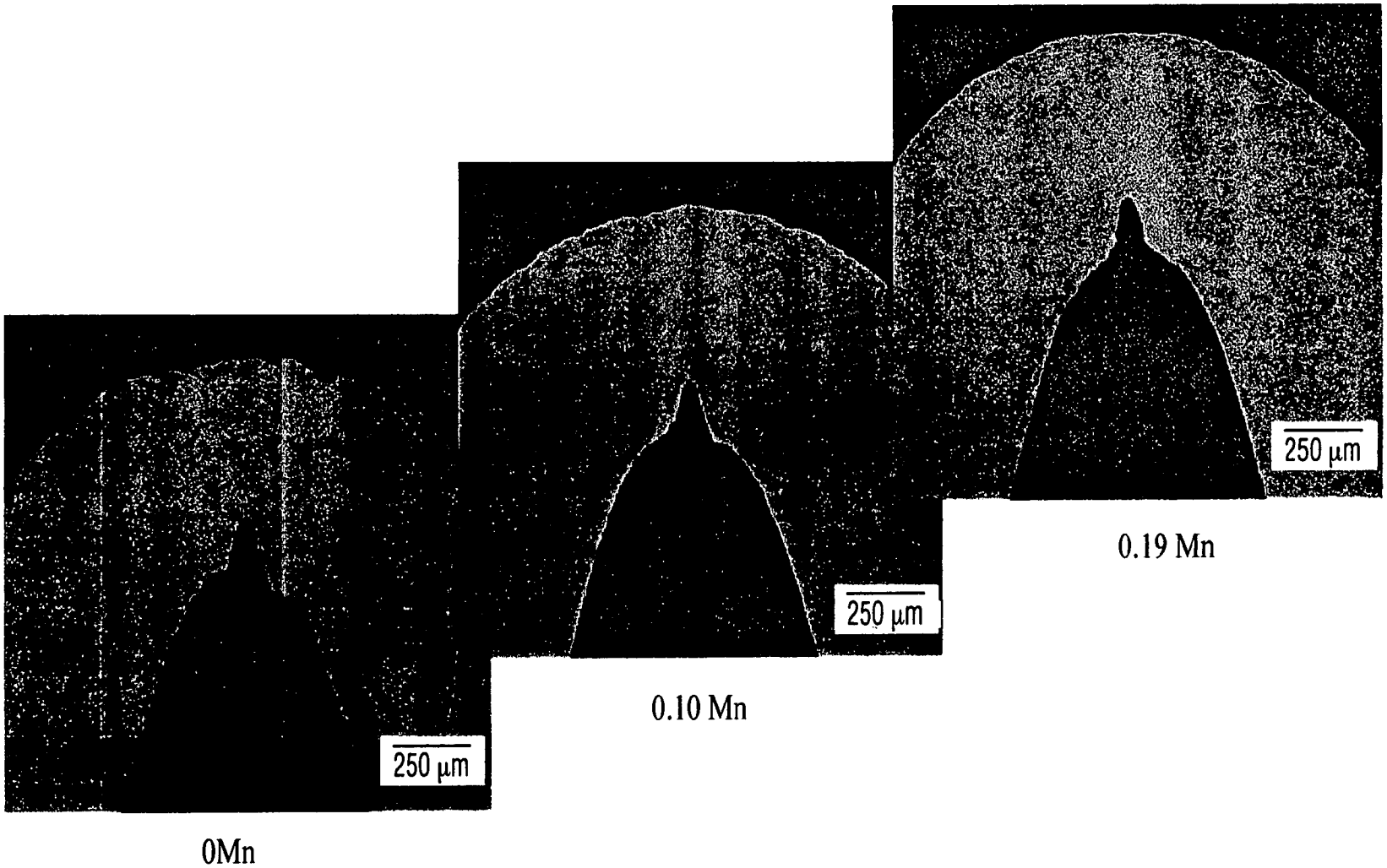
FIG. 1 shows the effect of Mn content on bendability.

(a) The alloys were DC cast 3.75×9 inch ingots and the ingot surface scalped, followed by homogenizing for 6 hours at 560° C. The ingots were then hot rolled followed by cold rolling to about 1 mm gauge. The sheet was solution heat treated for 15 seconds at 560° C., then quenched to 80° C. and coiled. The coil was then slowly cooled at a rate of 1.5–2.0° C./hr to ambient and naturally aged for one week. The results are shown in Table 3. FIG. 1 shows the effect of Mn content on bendability, For bendability of sheet without prestrain with the minimum r/t as observed by the naked eye, it is difficult to observe a clear trend-results are in Table 3. However, as seen in FIG. 1, the 0 wt % Mn alloy has a crack on the surface. At the 0.1 wt % Mn, the bend is crack free, but rumpling is visible on the surface. At 0.2 wt % Mn the surface is crack free and free from rumpling on the surface. It is though that the rumpling is a precursor to residual crack formation.

(b) In a further procedure, alloy AL3 was processed by production sized DC casting into ingots and homogenized for 1 hour at 560° C. The ingots were hot rolled to 5.9 mm reroll exit gauge, then cold rolled to 2.5 mm gauge. This intermediate gauge sheet was interannealed for 2 hours at 360° C., then further cold rolled to 1 mm gauge and solution heat treated at 560° C. Then the sheet was quenched to 80° C., coiled and pre-aged for 8 hours at 80° C.

The results are shown in Table 4.

TABLE 3

| | Properties | | | | | | | | | | |
|---|---|---|---|---|---|---|---|---|---|---|---|
| | | | Tensile Properties/T4P | | | | | Bake Response/T8(0%) | | | Bendability |
| | Alloy | Orien. | 0.2% YS (MPa) | UTS (MPa) | EL (%) | n value | R value | 0.2% YS (MPa) | UTS (MPa) | EL (%) | $r_{min.}/t$ 2% prestrain |
| Invention | AL3-T4P | L | 110 | 230 | 26 | 0.29 | 0.56 | 212 | 296 | 20 | 0 |
| | | T | 109 | 229 | 26 | 0.29 | 0.57 | 211 | 297 | 20 | 0 |
| | AL4-T4P | L | 105 | 222 | 24 | 0.29 | 0.54 | 210 | 291 | 20 | 0 |
| | | T | 103 | 222 | 23 | 0.29 | 0.54 | 212 | 292 | 19 | 0 |
| Comparison | C1-T4P | L | 110 | 230 | 27 | 0.29 | 0.58 | 195 | 283 | 22 | 0.15 |
| | | T | 111 | 232 | 25 | 0.29 | 0.63 | 196 | 287 | 19 | 0.15 |
| | C2-T4P | L | 106 | 223 | 26 | 0.29 | 0.6 | 204 | 289 | 20 | 0 |
| | | T | 106 | 224 | 25 | 0.29 | 0.56 | 198 | 285 | 22 | 0 |

TABLE 4

| | | | Properties | | | | | | | | |
|---|---|---|---|---|---|---|---|---|---|---|---|
| | | | Tensile Properties/T4P | | | | | Bake Response/T8 (0%) | | | Bendability |
| | I.D. | Orien. L | 0.2% YS (MPa) | UTS (MPa) | EL (%) | n value | R value | 0.2% YS (MPa) | UTS (MPa) | EL (%) | $r_{min.}/t$ 5% prestrain |
| Invention | AL3 | L | 102 | 225 | 26 | 0.29 | 0.73 | 205 | 291 | 20 | 0 |
| | | T | 99 | 219 | 24 | 0.3 | 0.61 | 199 | 283 | 20 | 0 |

The above is an excellent example of low yield strength, rapid age hardening and bendability even at 5% prestrain.

EXAMPLE 3

Tests were conducted on two alloys AL5 and AL6 with the casting and processing being done in commercial plants. The compositions of these alloys are shown in Table 6 below:

TABLE 5

| | Composition in wt % (ICP) | | | | | Coil # | Hot Rolling Gauge |
|---|---|---|---|---|---|---|---|
| Alloy | Cu | Mg | Si | Fe | Mn | Line B | (mm) |
| AL5 | 0.30 | 0.58 | 0.77 | 0.24 | 0.21 | B-1 | 3.5 |
| | 0.30 | 0.59 | 0.77 | 0.24 | 0.21 | B-2 | 2.54 |
| AL6 | | 0.58 | 0.77 | 0.24 | 0.22 | B-3 | 2.54 |
| | | 0.58 | 0.77 | 0.24 | 0.22 | B-4 | 3.5 |

Two ingots each of the AL5 and AL6 compositions given in Table 5 were DC cast, scalped, homogenized at 560° C. and hot rolled. One AL5 (Coil B-2) and one AL6 (Coil B-3) ingot were hot rolled to 2.54 mm, cold rolled in two passes to 0.93 mm gauge and solutionized to obtain the T4P temper. The other pair of AL1 (Coil B-1) and AL6 (Coil B-4) ingot, were hot rolled to 3.5 mm, cold rolled to 2.1 mm gauge in one pass, batch annealed, cold rolled to final gauge of 0.93 mm in two passes and then solutionized to obtain sheet in the T4P (intermediate gauge anneal) temper. The coils were batch annealed at 380° C. with a soak of ~2 h. Major portions of all the coils were solutionized on the CASH (continuous annealing and solution heat treatment) line at 550° C. using the T4P practice. The remaining portions of the coils were solutionized using the same procedure but at 535° C.

Samples of all coils were sheared-off at reroll, intermediate and final gauges for evaluations.

The microstructures in all four coils were optically examined and the grain structures quantified by measuring the sizes of 150 to 200 grains at ¼ thickness. The mechanical properties were determined after five and six days of natural ageing, and the bend radius to sheet thickness ratio, r/t, was determined using the standard wrap bend test method. The minimum r/t value was determined by dividing the minimum radius of the mandrel that produced a crack free bend by the sheet thickness. The radius of the mandrels used for the measurements were 0.001", 0.002", 0.003", 0.004", 0.006", 0.008", 0.01", 0.012", 0.016", 0.02", 0,024" and so on, and the bendability can vary within a difference of one mandrel size.

The as-polished microstructures in both the 0.3% Cu containing AL5 and Cu-free AL6 sheets show the presence of coarse elongated Fe-rich platelets lying parallel to the rolling direction. The alloys also contain a minor amount of undissolved $Mg_2Si$, except for the AL6 alloy solutionized at 535° C. which contains relatively large amounts.

The results of grain size measurements in Table 6 show that the grain structure in AL5 and AL6 sheets solutionized at 535° C. and 550° C. are not influenced by changing the solutionizing temperature from 535 to 550° C. Alloys AL5 and AL6 show an average grain size of about 34×14 μm and 35×19 μm (horizontal×through thickness), respectively. In general, the grain size distribution in the horizontal direction: of both alloys is quite similar, although there are differences in the through thickness direction. The average through thickness grain size in the AL6 alloy is about 5 μm higher than in the Cu containing AL5 alloy.

TABLE 6

Grain Size Measurement Results Obtained from AL5 and AL6-T4P Sheets

| Alloy (Coil #) | Solution Temp (° C.) | Orient | Mean (μm) | Median (μm) | Std Dev. (μm) | Mean Aspect Ratio (H/V) | % Grains (>μm) |
|---|---|---|---|---|---|---|---|
| AL5 | 535 | H | 34.4 | 30.3 | 18.2 | 2.44 | 31.1 |
| B-2 | | V | 14.1 | 13.0 | 5.9 | | 0.8 |
| | 550 | H | 33.0 | 29.3 | 18.6 | 2.26 | 25.7 |
| | | V | 14.6 | 14.1 | 6.8 | | 0 |
| AL6 | 535 | H | 36.4 | 32.3 | 20.2 | 1.87 | 32.5 |
| B-3 | | V | 19.5 | 17.7 | 10.6 | | 3.0 |
| | 550 | H | 33.0 | 29.9 | 16.0 | 1.70 | 29.5 |
| | | V | 19.4 | 18.5 | 7.8 | | 2.0 |

H: Along Rolling Directions,

V: Perpendicular to the Rolling Direction.

Figure 2:
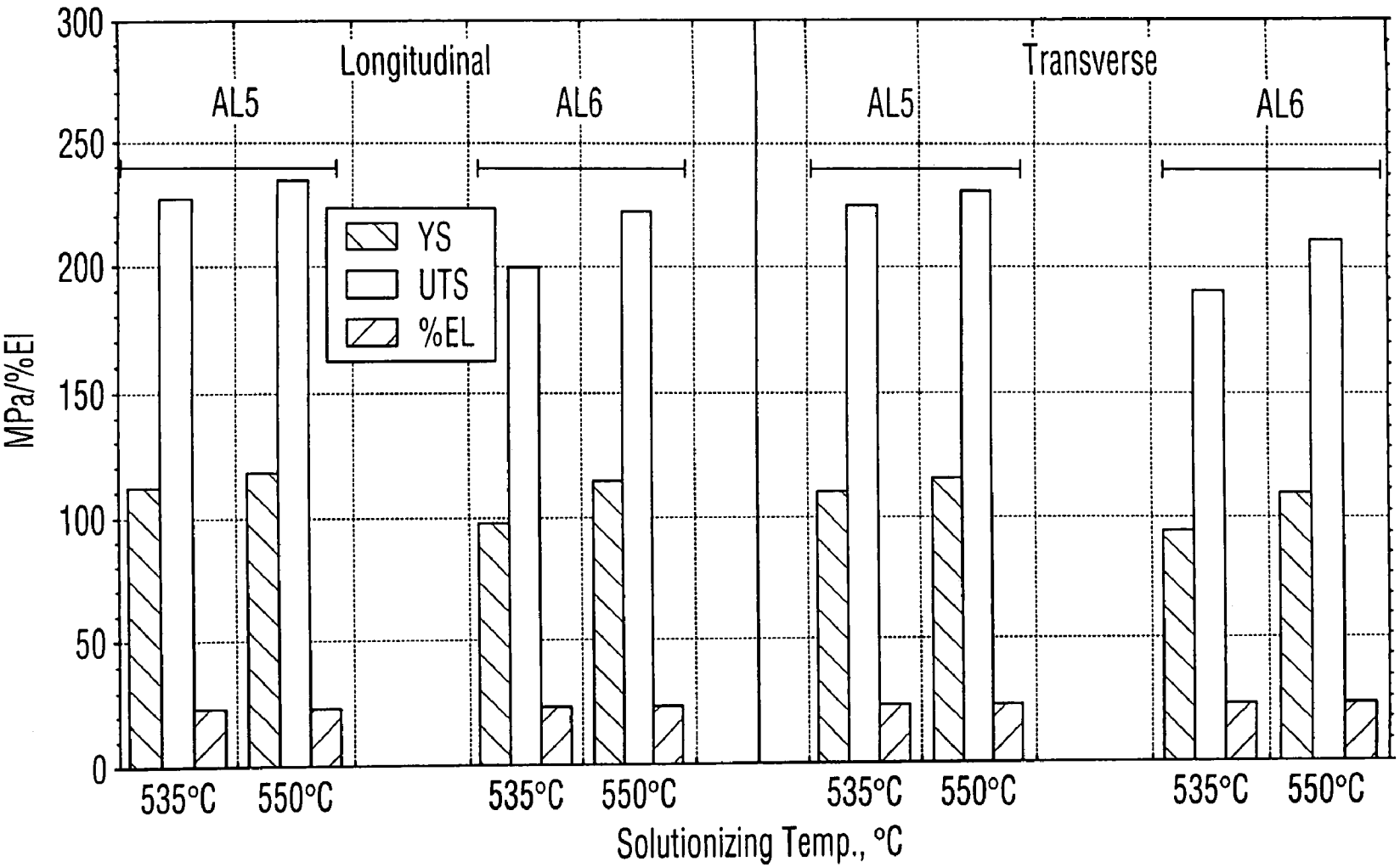
FIG. 2 is a graph showing the effects of solutionizing temperature on tensile properties (T4P)

The tensile and bend properties of the T4P temper coils in the L and T directions are listed in Table 7. FIG. 2 compares the tensile properties of the 0.3% Cu containing AL5 and Cu free AL6 alloys and highlights the differences due to changes in the temperature from 550 to 535° C. The AL5 is stronger than the AL6 alloy in both L and T directions at both solutionizing temperatures. The yield and tensile strengths of both alloys are somewhat increased with the higher solutionizing temperature, although the impact is most significant for the AL6 alloy. It should be noted that the lower strength of the AL6 alloy is consistent with the presence of a large amount of undissolved $Mg_2Si$ particles.

TABLE 7

Mechanical Properties of AL5 and AL6 Sheets in the T4P Temper

| Alloy (Coil #) | Solution Temp (° C.) | Temper | Dir. | YS (MPa) | UTS (MPa) | Total % El | n | R | Min (r/t) |
|---|---|---|---|---|---|---|---|---|---|
| AL5 | 535 | T4P | L | 112.7 | 227.8 | 23.3 | 0.28 | 0.67 | 0.06 |
| B-2 | | | T | 109.5 | 225.3 | 24.3 | 0.28 | 0.80 | 0.06 |
| | | T8(2%) | L | 262.7 | 318.1 | 17.2 | 0.13 | 0.67 | — |
| | | | T | 256.3 | 313.3 | 18.5 | 0.14 | 0.80 | — |
| | 550 | T4P | L | 118.1 | 235.2 | 23.6 | 0.28 | 0.65 | 0.16 |
| | | | T | 114.8 | 232.4 | 25.7 | 0.27 | 0.81 | 0.16 |
| | | T8(2%) | L | 269.2 | 324.3 | 17.5 | 0.13 | 0.67 | — |
| | | | T | 261.3 | 319.1 | 18.1 | 0.14 | 0.83 | — |
| AL6 | 535 | T4P | L | 98.5 | 199.7 | 23.4 | 0.27 | 0.80 | 0.16 |
| B-3 | | | T | 94.5 | 191.2 | 22.8 | 0.27 | 0.78 | 0.05 |
| | | T8(2%) | L | 223.1 | 279.1 | 15.7 | 0.14 | 0.80 | — |
| | | | T | 212.5 | 266.3 | 16.6 | 0.14 | 0.82 | — |
| | 550 | T4P | L | 114.5 | 222.3 | 23.8 | 0.27 | 0.82 | 0.16 |
| | | | T | 109.5 | 212.52 | 22.4 | 0.27 | 0.69 | 0.05 |
| | | T8(2%) | L | 259.2 | 312.6 | 16.8 | 0.13 | 0.87 | — |
| | | | T | 248.1 | 298.3 | 16.4 | 0.13 | 0.71 | — |

Figure 3:
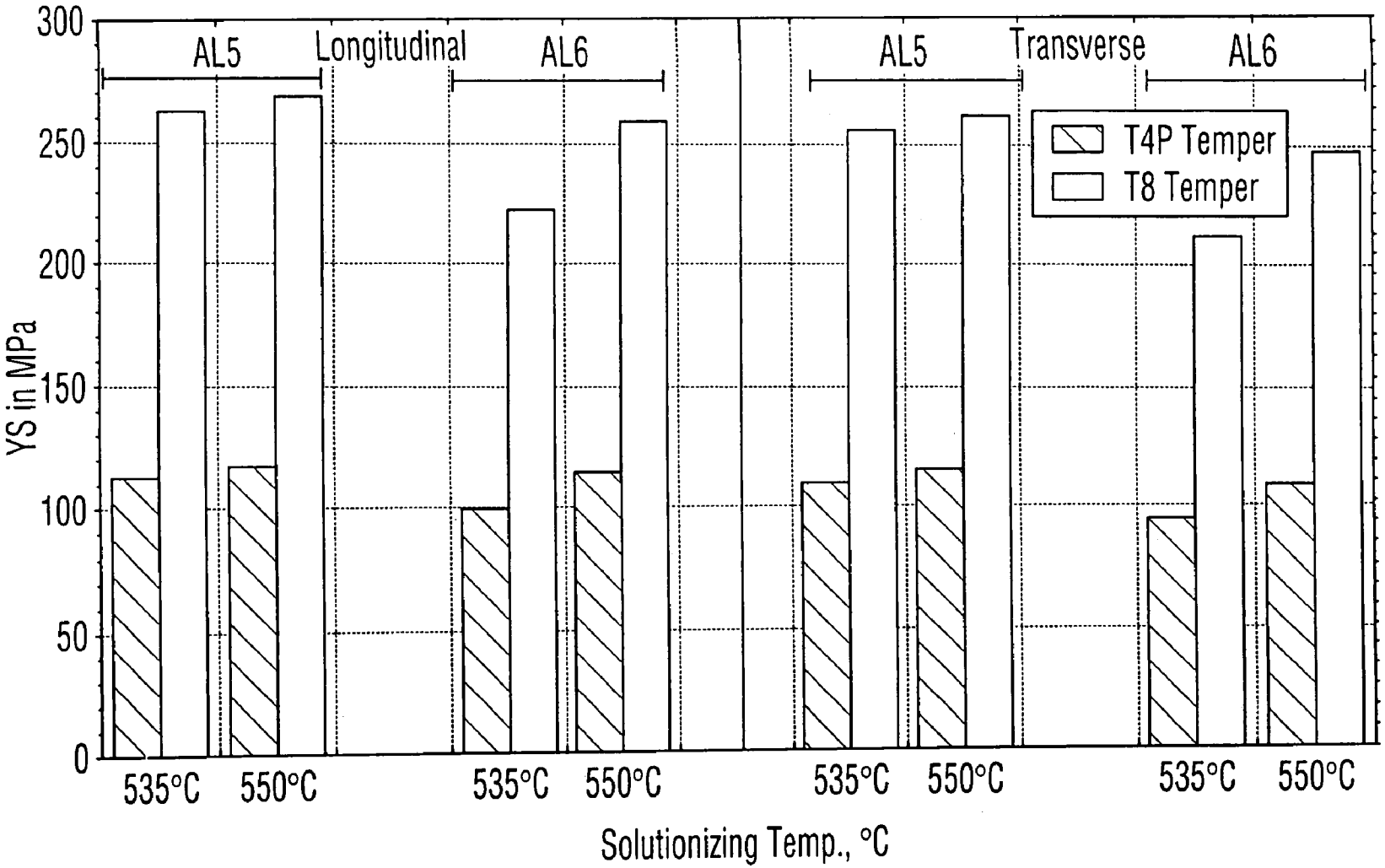
FIG. 3 is a graph showing the effects of solutionizing temperature on YS (T4P and T8 [0%])

The paint bake response, which is the difference between the YS in the T4P and T8(2%) tempers, is compared in FIG. 3. It can be seem that the changes in the solutionizing temperature does not influence the paint bake response of the AL5, but affects that of the AL6 alloy significantly. As pointed out above, the latter is related to the presence of undissolved $Mg_2Si$ which "drain" the matrix of hardening solutes. The paint bake response of the AL5 alloy is about 150 MPa and is ~10 MPa better than the AL6 alloy when solutionized at 550° C. Both alloys clearly show excellent combinations of low strengths in the T4P temper and high strength in the T8(2%) temper.

Figure 4:
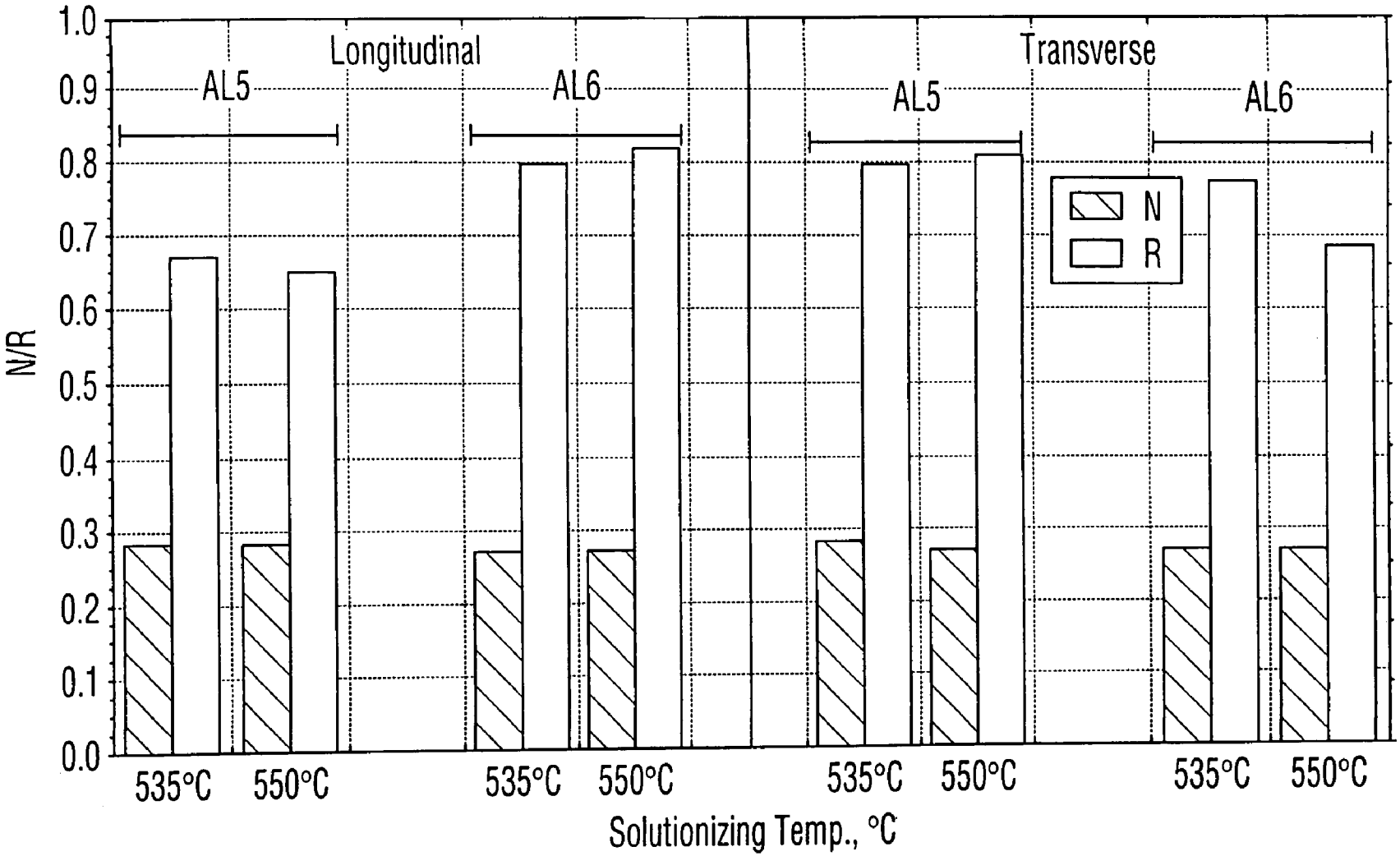
FIG. 4 is a graph showing the effects of solutionizing temperature on N and R values (T4P)

The n and R values measured from tensile test data for the T4P temper materials are shown in FIG. 4. The n values in both alloys are quite similar, isotropic and do not change with the solutionizing temperature. The R-value in the AL5 alloy is marginally lower than the AL6 alloy in the L direction, but the trend is reversed in the T direction.

Figure 5:
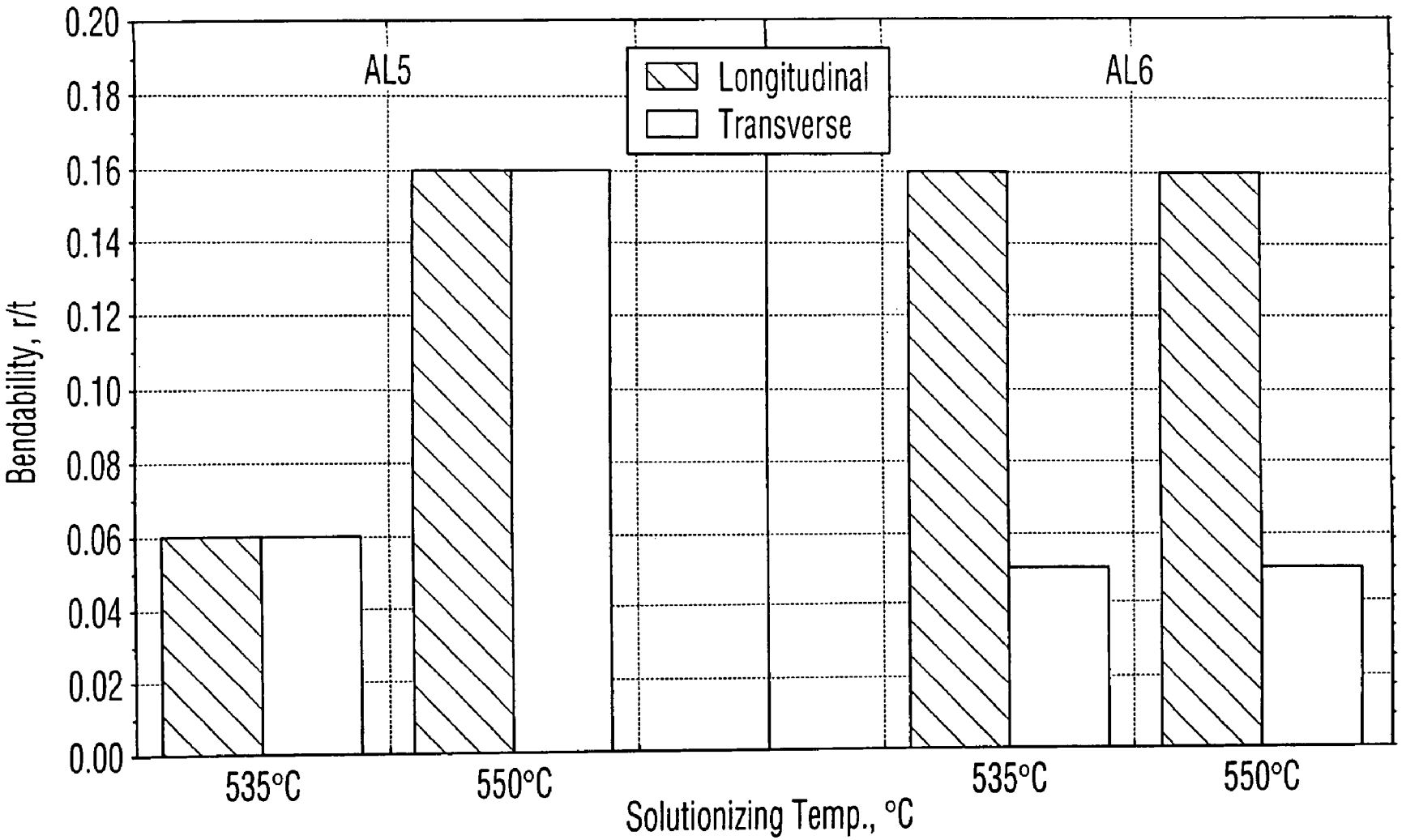
FIG. 5 is a graph showing the effects of solutionizing temperature on bendability (T4P)

FIG. 5 shows that the r/t values of both the alloys are lower than 0.2 in L and T directions. The r/t value for the 0.3% Cu containing AL5 alloy is marginally better than its Cu free counter and the best value is obtained at the lower solutionizing temperature.

It will be noted that a combination of ~100 MPa and above 250 MPa YS's in the T4P and T8(2%) tempers has not been seen in conventional automotive alloys. Furthermore, the paint bake response of the AL5 and AL6 alloys is better than conventional AA6111.

For the material with the interanneal, the size and distribution of the coarse Fe-rich platelets in the L sections of the AL5 (Coil B-1) and the AL6 (Coil B-4) are similar to the T4P temper coils. The amount of undissolved $Mg_2Si$ in the T4P coils (interannealed) was found to be generally higher than in their T4P temper counterpart, especially at a solutionizing temperature of 535° C.

Table 8 summarizes the results of grain size measurements. Generally, the lowering of the solutionizing temperature has no measurable effect on the grain structure. The average grain sizes and the distribution in the AL5 sheet are somewhat refined compared to its T4P counterpart, although the opposite is true for the AL6 coil, see Tables 6 and 8. The overall grain size spread in the AL6 alloy becomes quite large compared to that in the T4P temper. Generally, the average grain size in the AL5 coil is about 10 μm smaller than for the AL6 sheet in both through thickness and horizontal directions.

TABLE 8

Grain Size Measurements Results from the AL5 and AL6 Sheets in the T4P Temper

| Alloy (Coil#) | Orient | Solution Temp. (° C.) | Mean (μm) | Med. (μm) | Std. Dev. (μm) | Mean Aspect Ratio, H/V | % Grains (>40 μm) |
|---|---|---|---|---|---|---|---|
| AL5 | H | 535 | 29.2 | 26.0 | 16.4 | 1.69 | 21.5 |
| B-1 | V | | 17.2 | 15.6 | 8.5 | | 1.9 |
| | H | 550 | 27.6 | 25.4 | 15.8 | 1.48 | 18.4 |
| | V | | 18.6 | 16.9 | 8.1 | | 1.0 |
| AL6 | H | 535 | 39.9 | 36.5 | 19.8 | 1.53 | 42.3 |
| B-4 | V | | 26.1 | 22.1 | 11.4 | | 12.2 |
| | H | 550 | 42.4 | 38.2 | 21.8 | 1.61 | 47.7 |
| | V | | 26.3 | 23.2 | 13.9 | | 15.1 |

Figure 6:
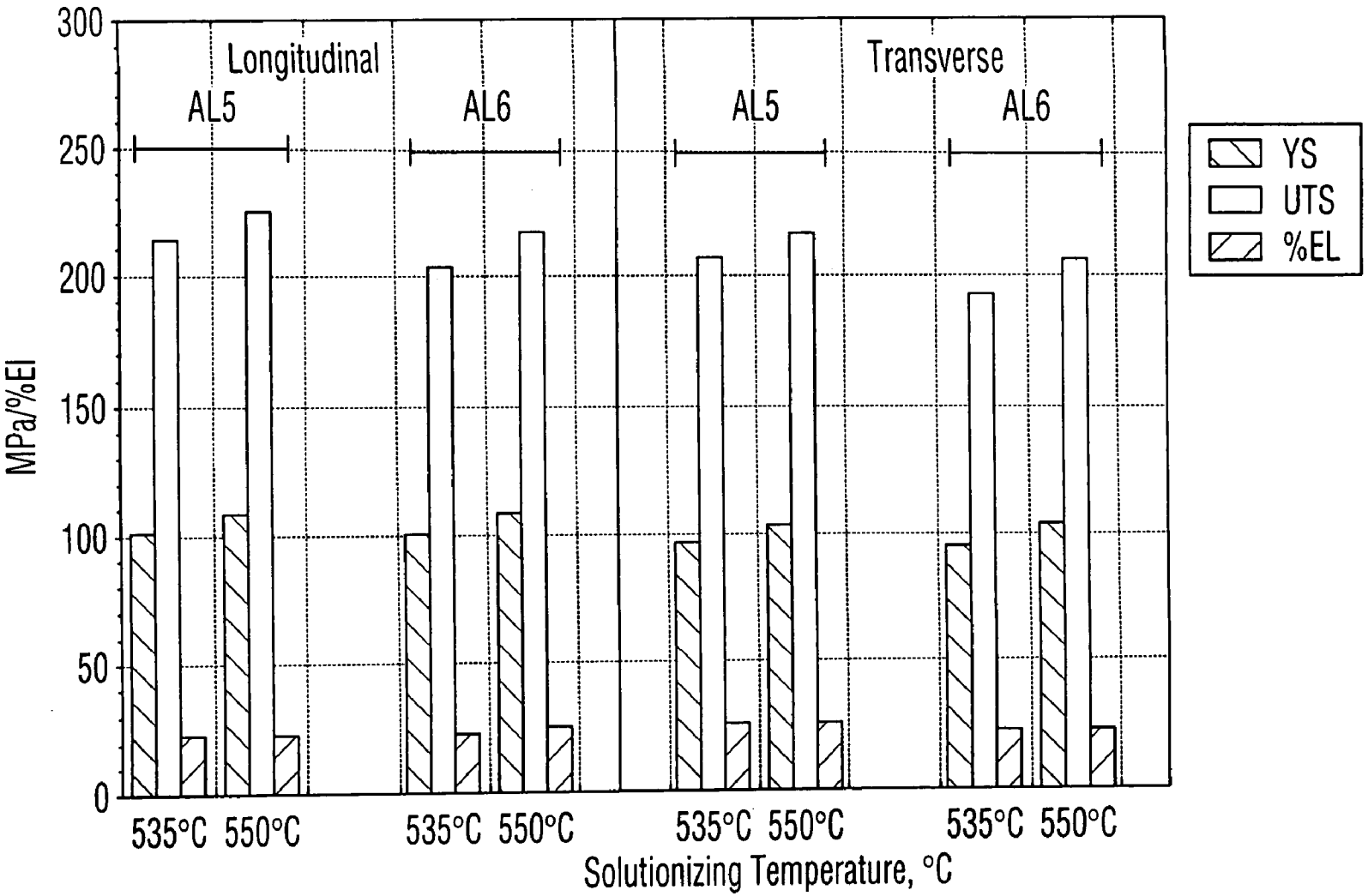
FIG. 6 is a graph showing the effects of solutionizing temperature on tensile properties (T4P with interanneal)

The tensile and bend properties of the coils are listed in Table 9. FIG. 6 compares the tensile properties of the AL5 and AL6 alloys in the L and T directions, and highlights the differences caused by solutionizing at the two different temperatures. As in the T4P temper, the AL5 in the T4P temper with interanneal is marginally stronger than the AL6 alloy in both L and T directions and for both solutionizing temperatures. In addition, the strength of the two alloys is slightly improved by solutionizing at 550° C. as opposed to 535° C., although no significant effects are obvious in the elongation values. The strength in both alloys vary within ~12 MPa in both L and T directions, while no major differences are noted in the elongation values.

TABLE 9

Mechanical Properties of AL5 and AL6 Sheets Produced In the T4P Temper with Interanneal

| Alloy (Coil #) | Solutionizing Temp. (° C.) | Temper | Dir. | YS (MPa) | UTS, (MPa) | Total % El | n | R | Min (r/t) |
|---|---|---|---|---|---|---|---|---|---|
| AL5 | 535 | T4P | L | 101.1 | 212.7 | 23.9 | 0.29 | 0.70 | 0.11 |
| (B-1) | | | T | 96.2 | 204.7 | 24.9 | 0.28 | 0.67 | 0.06 |
| | | T8P | L | 236.6 | 296.1 | 15.5 | 0.14 | 0.74 | — |
| | | | T | 231.2 | 286.9 | 17.0 | 0.14 | 0.74 | — |
| | 550 | T4P | L | 108.6 | 225.6 | 24.6 | 0.29 | 0.71 | 0.16 |
| | | | T | 103.5 | 217.1 | 25.7 | 0.28 | 0.67 | 0.11 |
| | | T8(2%) | L | 255.9 | 313.8 | 17.1 | 0.13 | 0.74 | — |
| | | | T | 244.8 | 301.6 | 17.7 | 0.14 | 0.69 | — |
| AL6 | 535 | T4P | L | 100.1 | 203.1 | 23.0 | 0.27 | 0.84 | 0.17 |
| (B-4) | | | T | 95.6 | 194.0 | 22.8 | 0.27 | 0.64 | 0.06 |
| | | T8(2%) | L | 226.4 | 282.7 | 16.6 | 0.14 | 0.86 | — |
| | | | T | 216.6 | 271.4 | 15.9 | 0.14 | 0.67 | — |
| | 550 | T4P | L | 109.4 | 217.3 | 24.7 | 0.27 | 0.85 | 0.17 |
| | | | T | 104.4 | 207.6 | 22.5 | 0.27 | 0.63 | 0.06 |
| | | T8(2%) | L | 253.7 | 306.7 | 17.1 | 0.13 | 0.85 | — |
| | | | T | 244.5 | 295.3 | 15.6 | 0.13 | 0.68 | — |

n = strain hardening index
R = resistance to thinning

Figure 7:
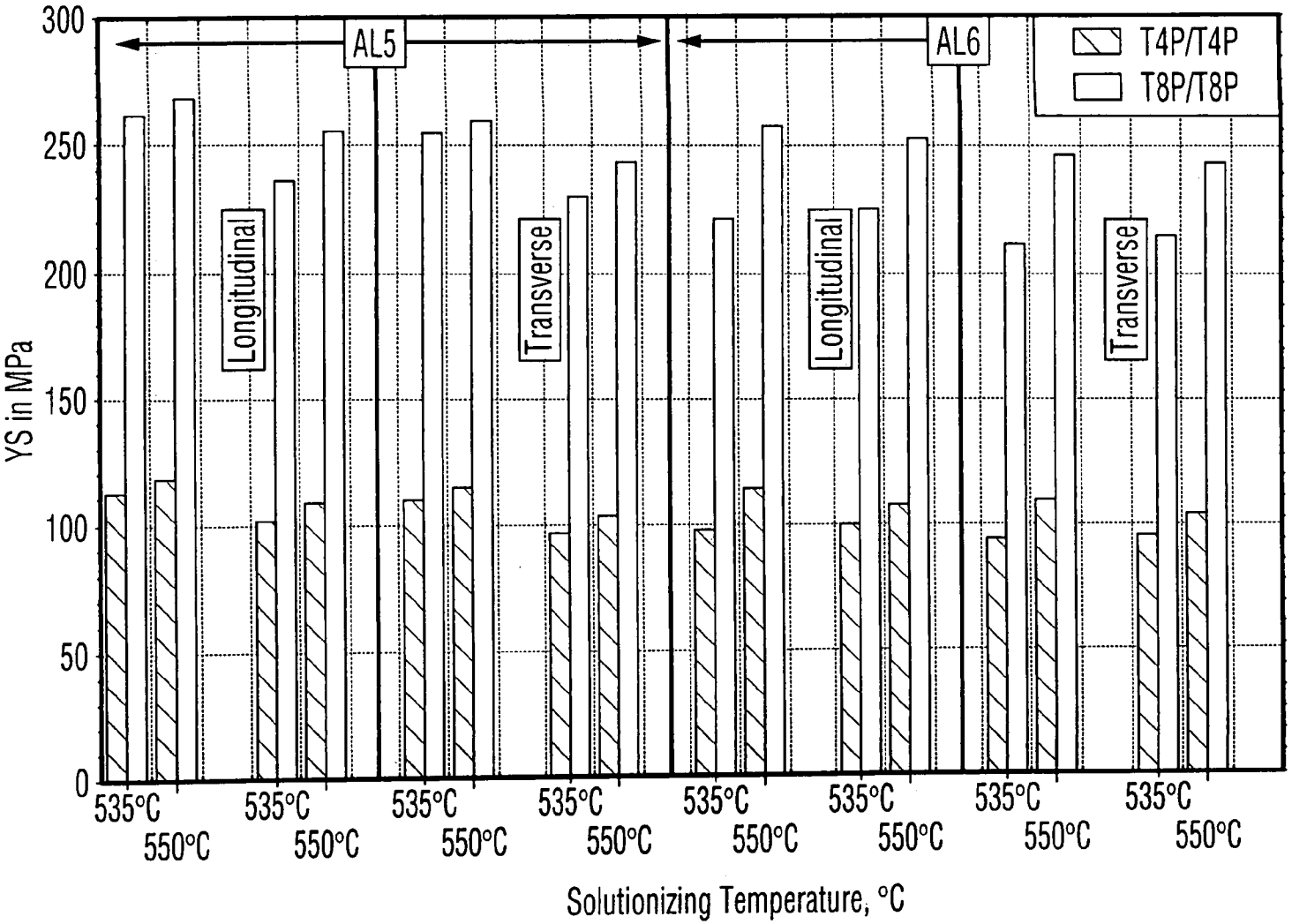
FIG. 7 is a graph showing a comparison of YS values for different tempers.

The paint bake response of the two coils is compared in FIG. 7. This figure shows that the change of solutionizing temperature from 535 to 550° C. improves the paint bake response by about 6 to 19 MPa, where most of the improvement is seen in the AL6 alloy, The paint bake response of the AL5 alloy solutionized at 550° C. is around 148 MPa, which is about 8 MPa better than its AL6 counterpart.

Figure 8:
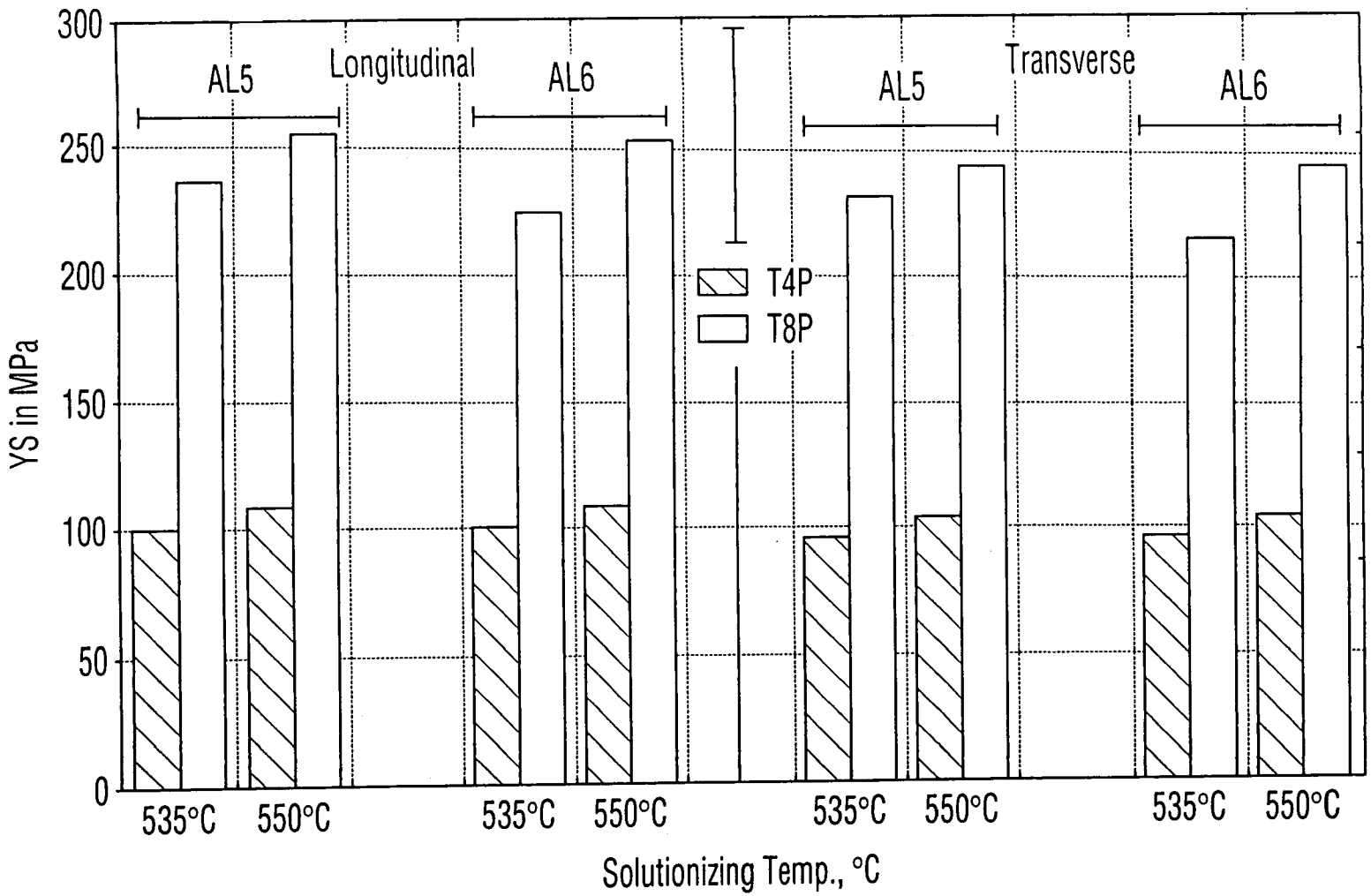
FIG. 8 is a graph showing the effects of solutionizing temperature on YS (T4P and T8(2%) with interanneal)

The YS of the AL5 and AL6 alloys produced with and without batch interannealing are compared in FIG. 8. The use of batch annealing reduces the YS in both the T4P and T8(2%) tempers. It is necessay that the alloys be solutionized at 550° C. to maximize the paint bake response of the alloys. However, it should be noted that the paint bake response of the AL5 and AL6 alloys solutionized at 535° C. is still comparable to the conventional AA6111.

Figure 9:
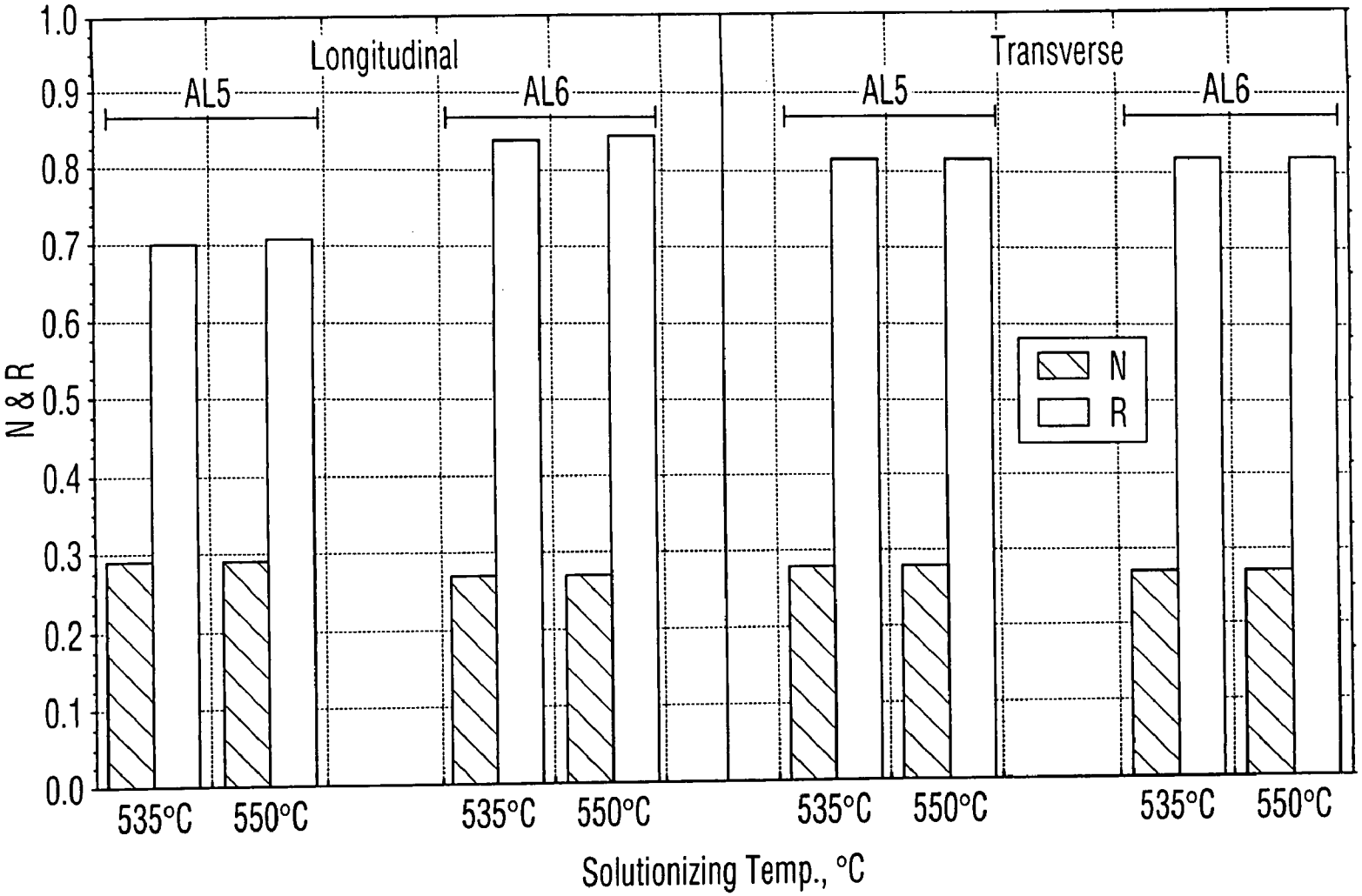
FIG. 9 is a graph showing the effects of solutionizing temperature on N and R values (T4P with interanneal)

The n and R values of the two alloys are shown in FIG. 9. As in the T4P temper, the n values (strain hardening index) in both the alloys are quite similar, isotropic and do not change with the solutionizing temperature. The R-value (resistance to thinning) in the AL5 alloy is lower than the AL6 alloy in the L directions, but the trend is reversed in the T direction. The trend in R-values is similar to that seen in the T4P temper.

Figure 10:
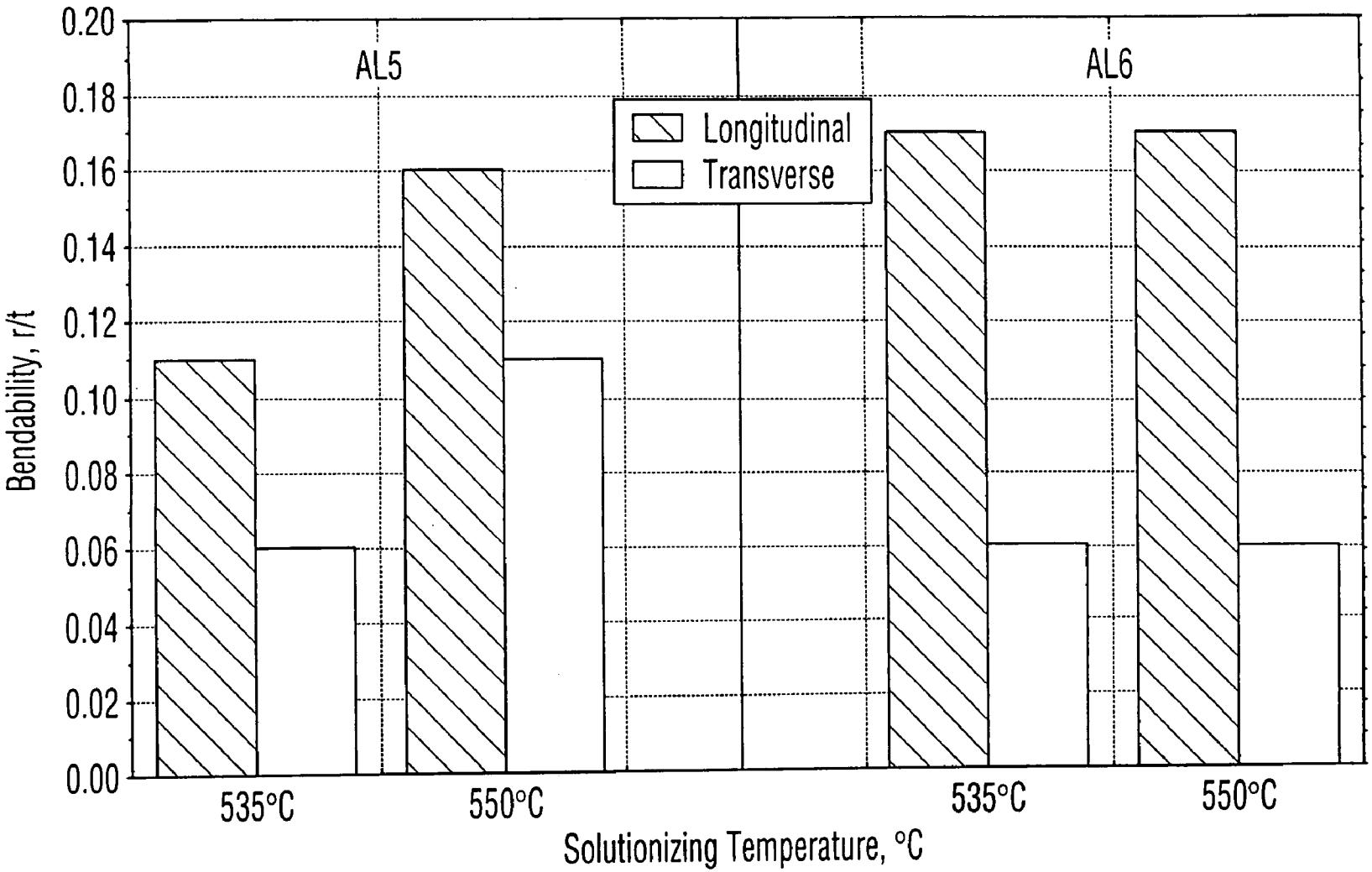
FIG. 10 is a graph showing the effects of solutionizing temperate on bendability (T4P with interanneal).
Figure 11A:
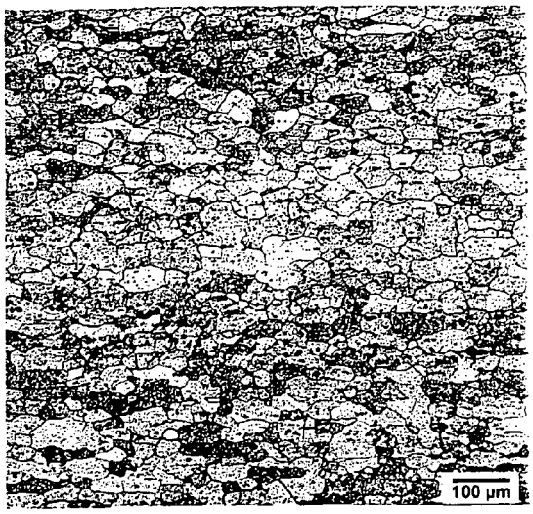
FIG. 11*a* shows the grain structure of a T4P temper sheet from a large ingot of alloy containing Cu.
Figure 11B:
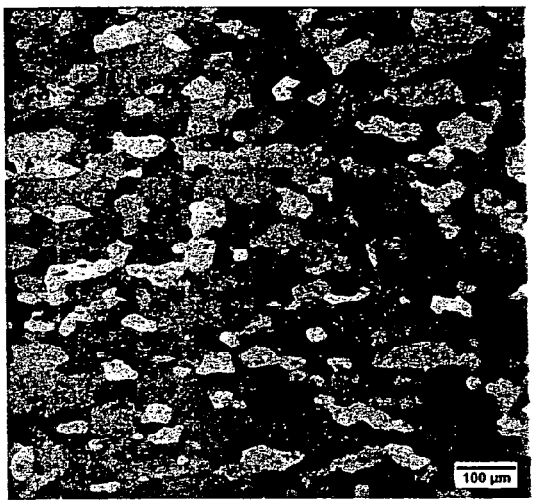
FIG. 11*b* shows the grain structure of a T4P temper sheet from a large ingot alloy without Cu.
Figure 11C:
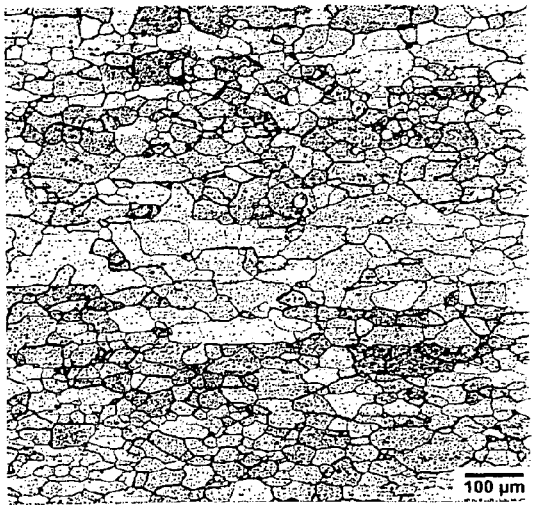
FIG. 11*c* shows the grain structure of a T4P temper sheet from a small ingot alloy containing Cu.
Figure 11D:
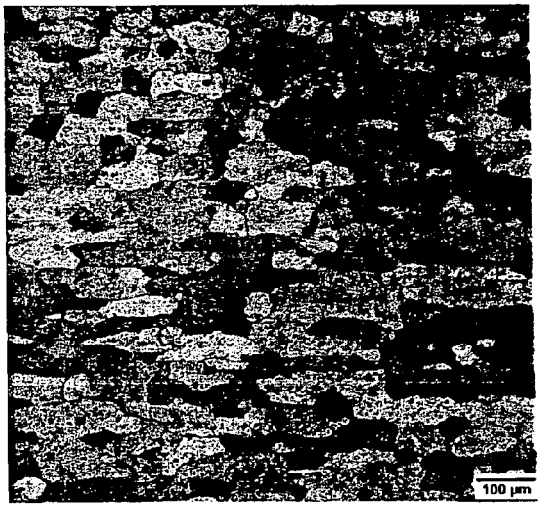
FIG. 11*d* shows the grain structure of a T4P temper sheet from a small ingot alloy without Cu.

FIG. 10 shows that the r/t values of the two alloys are lower than 0.2 in the L and T directions. While the r/t values of the 0.3% Cu containing AL5 alloy solutionizing at 535° C. are better than its Cu free counterpart, this advantage is lost by solutionizing at 550° C.

EXAMPLE 4

One 600×2032 mm (thick×wide) and about 4000 mm long ingots each of the AL7 and AL8 compositions given in Table 10 was direct chill (DC) cast at a commercial scale. The liquid aluminum melt was alloyed between 720 and 750° C. in a tilting furnace, skimmed, fluxed with a mixture of about 25/75 $Cl_2/N_2$ gases for about 35 minutes and in line degassed with a mixture of Ar and $Cl_2$ injected at a rate of 200 l/min and 0.5 l/min, respectively. The alloy melt then received 5% Ti-1% B grain refiner and poured into a lubricated mould between 700 and 715° C. using a duel bag feeding system. The duel bag system was used to reduce the turbulence at the spout. The casting was carried out at a slow speed of about 25 mm/min in the beginning and finished at about 50 mm/min. The as-cast ingot was controlled cooled by pulsating water at a rate between 25 and 80 l/s to avoid cracking. The ingots were scalped, homogenized at 560° C. and hot rolled. The ingots were hot rolled to 3.5 mm, cold rolled to 2.1 mm gauge in one pass, batch annealed at 380° C. for 2 h, cold rolled to the final gauge of 0.93 mm and then solutionized to obtain sheet in the T4P temper (with interanneal).

Alloys AL7 and AL8 alloys were also cast as 95×228 mm (thick×wide) size DC ingots for comparison purposes. The liquid aluminum was degassed with a mixture of about 10/90 $Cl_2$/Ar gases for about 10 minutes and then 5% Ti-1% B grain refiner added in the furnace. The liquid alloy melt was poured into a lubricated mould between 700 and 715° C. to cast ingot at a speed between 150 and 200 mm/min. The ingot exiting the mould was cooled by a water jet. The small ingots were processed in a similar manner to commercial size ingot, except for the fact that the processing was carried out in the laboratory using plant simulated processing conditions.

FIGS. 11*a*–11*d* compares the grain structures in the AL7 and AL8 alloys sheets obtained from both large and small size ingots. It can be seen that the grain size is quite coarse in sheet material obtained from small size ingots, specifically at ½ thickness locations. Table 11 lists the results of grain size measurements from about 150 to 200 grains in horizontal (H) and through thickness (V) directions at ¼ thickness locations. Table 11 shows that the average grain sizes and the distribution in the AL7 sheet are somewhat comparable in the AL7 sheets irrespective to the parent ingot size. However, it should be noted by comparing FIG. 11*a* with 11*c* that the grain size across thickness in the AL7 alloy varies quite considerably. Generally, the average grain size and grain size spread in the AL8 alloy is quite large compared to that in AL7 alloy. The average grain size in the AL7 sheet fabricated from the large ingot is about 15 μm and 8 μm smaller than for the AL8 sheet in both horizontal and through thickness directions, respectively. The difference in the horizontal direction is much higher in case of sheets fabricated from the small size ingot. The difference between the grain size in the AL8 sheets obtained from large and small size ingots is quite remarkable and appears to be related to casting conditions, see Table 11.

TABLE 10

Nominal Compositions of the AL7 and AL8 Cast Ingots

| Alloy | Composition in wt % | | | | |
|---|---|---|---|---|---|
| | Cu | Mg | Si | Fe | Mn |
| Sheets Produced from 600 mm Thick and 2032 mm Wide Ingots | | | | | |
| AL7 | 0.30 | 0.59 | 0.81 | 0.25 | 0.21 |
| AL8 | 0.03 | 0.59 | 0.80 | 0.25 | 0.22 |
| Sheets Produced from 94 mm Thick and 228 mm Wide Ingots | | | | | |
| AL7 | 0.31 | 0.60 | 0.79 | 0.20 | 0.20 |
| AL8 | — | 0.60 | 0.79 | 0.16 | 0.20 |

Figure 12:
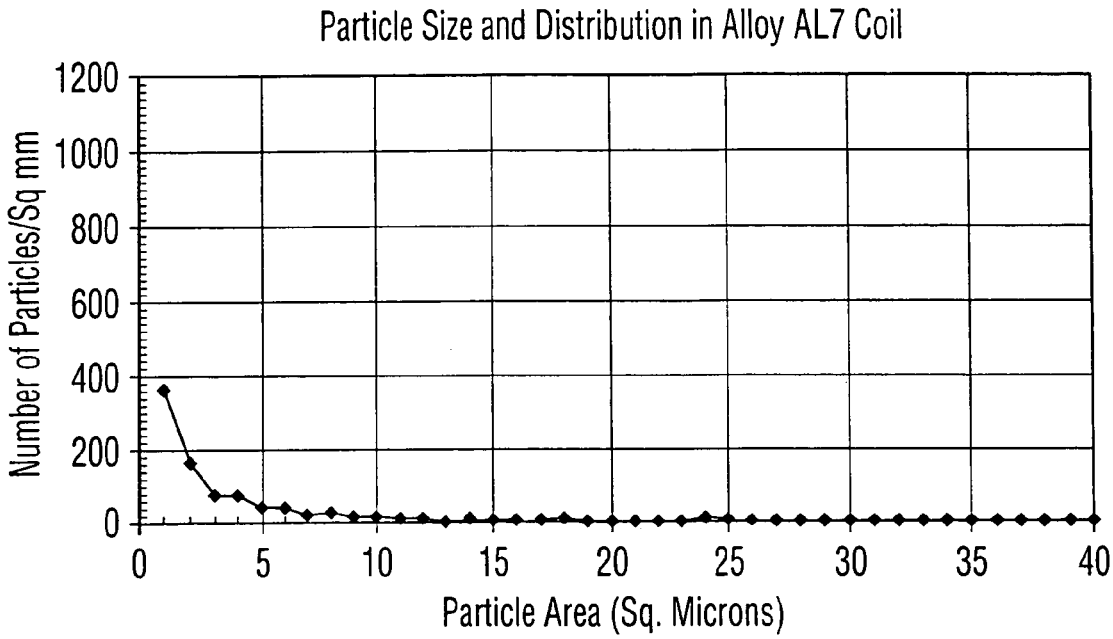
FIG. 12 is a plot of particle numbers per sq. mm v. particle area for a T4P temper coil containing Cu.
Figure 13:
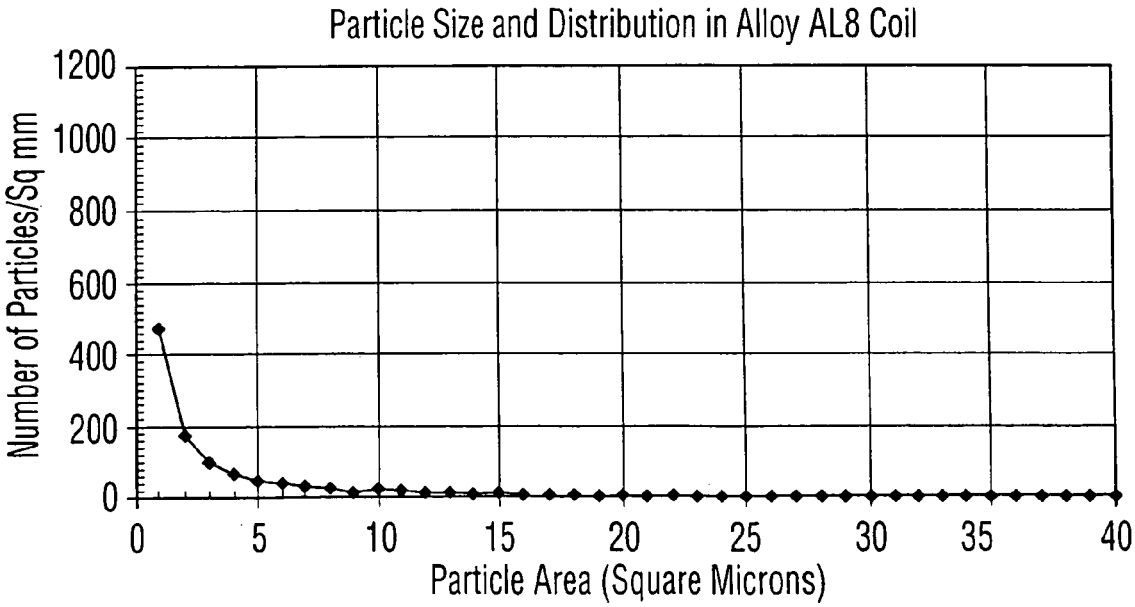
FIG. 13 is a plot of particle numbers per sq. mm v. particle area for a T4P temper coil without Cu.

FIGS. 12 and 13 show particle size and distribution in coil of alloys AL7 and AL8 processed commercial scale from large size ingots. From these plots it can be seen that about 85–95% of the particles have particle areas within the range of 0.5–5 sq. microns and about 80–100% of the particles have particle areas within the range of 0.5–15 sq. microns.

TABLE 11

Grain Size Measurements Results from the AL7 and AL8 Sheets in the T4P Temper (with Interanneal)

| Alloy | Orientation | Mean (μm) | Med. (μm) | Std. Dev. (μm) | Mean Aspect Ratio, H/V | % Grains (>40 μm) |
|---|---|---|---|---|---|---|
| Sheets Produced from Large Size Ingots via Commercial Scale Processing | | | | | | |
| AL7 | H | 27.6 | 25.4 | 15.8 | 1.48 | 18.4 |
| | V | 18.6 | 16.9 | 8.1 | | 1.0 |
| AL8 | H | 42.4 | 38.2 | 21.8 | 1.61 | 47.7 |
| | V | 26.3 | 23.2 | 13.9 | | 15.1 |
| Sheets Produced from Small Size Ingots via Simulated Commercial Scale Processing | | | | | | |
| AL7 | H | 31.0 | 26.3 | 20.5 | 1.59 | 24.5 |
| | V | 19.5 | 17.1 | 9.9 | | 9.9 |
| AL8 | H | 64.4 | 54.8 | 37.1 | 2.27 | 67.0 |
| | V | 28.3 | 24.6 | 16.4 | | 16.7 |

The invention claimed is:

1. A process of producing an aluminum alloy sheet having excellent bendability for use in forming panels for automobiles, the process comprising the steps of:

semi-continuously casting an aluminum alloy comprising 0.50 to 0.75% by weight Mg, 0.7 to 0.85% by weight Si, 0.1 to 0.3% by weight Fe, 0.15 to 0.35% by weight Mn, and the balance Al and incidental impurities, subjecting the cast alloy ingot to hot rolling and cold rolling to an intermediate gauge, batch annealing the intermediate gauge sheet, further cold rolling the annealed sheet to final gauge and heat treating the further cold rolled sheet, quenching the heat treated sheet to a temperature of about 60–1200° C. and coiling the sheet, and pre-aging the coil by slowly cooling the coil from an initial temperature of about 60–1200° C. to room temperature at a cooling rate of less than 10° C./hr., thereby obtaining a sheet having a bendability (r/t) value of less than 0.2.

2. A process according to claim 1 wherein the alloy also contains 0.2 to 0.4% Cu.

3. A process according to claim 1 wherein the coil is cooled at a rate of less than 5° C./hr.

4. A process according to claim 1 wherein the coil is cooled at a rate of less than 3° C./hr.

5. A process according to claim 1 wherein the heat treated sheet is quenched to a temperature of about 70–100° C.

6. A process according to claim 1 wherein the heat treated sheet is quenched to a temperature of about 80–90° C.

7. A process according to claim 1 wherein after the pre-aging, the coil is naturally aged to T4P temper.

8. A process according to claim 1 wherein the sheet obtained has a YS of less than 125 MPa in the T4P temper and greater than 250 MPa in the T8(2%) temper.

9. A process according to claim 8 wherein the sheet obtained has a YS of less than 120 MPa in the T42P temper and greater than 245 MPa in the T8(2%) temper.

10. A process according to claim 1 wherein the cast ingot has a thickness of at least 450 mm and a width of at least 1250 mm.

* * * * *